US006331127B1

(12) United States Patent
Suzuki

(10) Patent No.: US 6,331,127 B1
(45) Date of Patent: Dec. 18, 2001

(54) MARINE ENGINE

(75) Inventor: Akitaka Suzuki, Shizuoka (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/499,982

(22) Filed: Feb. 8, 2000

(51) Int. Cl.[7] ..... B63H 21/38
(52) U.S. Cl. ..... 440/88; 123/41.31
(58) Field of Search ..... 440/88; 123/41.31

(56) References Cited

U.S. PATENT DOCUMENTS

| | | | | |
|---|---|---|---|---|
| 3,667,431 | | 6/1972 | Kueny et al. . | |
| 4,991,546 | * | 2/1991 | Yoshimura | 123/41.31 |
| 5,048,467 | | 9/1991 | Kojima . | |
| 5,531,620 | * | 7/1996 | Ozawa et al. | 440/89 |
| 5,769,038 | | 6/1998 | Takahashi et al. . | |
| 5,797,378 | * | 8/1998 | Kato | 123/516 |
| 5,904,605 | * | 5/1999 | Kawasaki et al. | 440/88 |

FOREIGN PATENT DOCUMENTS

| | | |
|---|---|---|
| 7-156885 | 6/1995 | (JP) . |
| 9-041963 | 2/1997 | (JP) . |
| 9-041965 | 2/1997 | (JP) . |
| 9-041966 | 2/1997 | (JP) . |
| 9-254882 | 9/1997 | (JP) . |
| 9-317426 | 12/1997 | (JP) . |
| 10-238358 | 9/1998 | (JP) . |

* cited by examiner

*Primary Examiner*—Sherman Basinger
(74) *Attorney, Agent, or Firm*—Knobbe, Martens, Olson & Bear, LLP

(57) ABSTRACT

An engine for a watercraft includes a cooling system having a coolant supply. The coolant supply supplies an engine coolant jacket with a flow of coolant that is controlled by a temperature dependent flow control valve. The coolant supply also supplies an exhaust conduit coolant jacket independently of the engine coolant jacket.

18 Claims, 6 Drawing Sheets

MARINE ENGINE

RELATED APPLICATIONS

This application is based on Japanese Patent Application No. 10-238785, filed Aug. 25, 1998.

BACKGROUND OF THE INVENTION

1. Field of the Invention

This invention relates to a marine engine, and more particularly to a cooling system employed in a marine engine.

2. Description of the Related Art

Personal watercraft, like other applications that use internal combustion engines as prime movers, are experiencing considerable public and governmental pressure to improve not only their performance, but also their exhaust emissions level. For example, due to the emissions generated by two-stroke powered watercraft, certain recreational areas have banned the operation of such watercrafts. These bans have decreased the popularity of personal watercraft, and have caused manufacturers of these types of watercraft to consider fuel injected engines to power their watercraft and/or other means to reduce emission levels.

Fuel injected engines are known to provide a significantly enhanced performance, power output, and emissions as compared to carburated engines. All even more significant improvement is achieved through direct cylinder injection. Direct cylinder injection may be accompanied by stratification or lean burning operation to further fuel economy and emission control.

The benefits of fuel injection are further enhanced through the control of the engine block temperature during operation. For example, it has been known to employ a thermostat within the cooling system of a watercraft so as to control the flow of coolant through the cooling system of a watercraft.

SUMMARY OF THE INVENTION

A need therefore exists for a marine engine having a cooling system which can accurately control the temperature of the engine block during operation. Additionally, it is desirable to cool the engine block as well as other components simultaneously, during operation. For example, it is desirable to provide a cooling system for a marine engine which precisely controls the temperature of the engine block during operation, but does not allow the exhaust system to become overheated.

According to one aspect of the present invention, a marine engine for a watercraft includes an engine body defining a combustion chamber and a coolant jacket therein. The watercraft includes an exhaust conduit communicating with the combustion chamber and extending to an exhaust discharge arranged to discharge exhaust gases flowinig through the exhaust conduit to the atmosphere. The exhaust conduit also includes a coolant jacket in thermal communication with at least a portion thereof. The watercraft includes a coolant supply configured to generate pressurized coolant, a cooling system having a first coolant flow path extending from the coolant supply, through the engine coolant jacket and through a temperature dependent flow control valve, and a second coolant flow path extending from at least one of the coolant supply and a portion of the first coolant flow path upstream from the temperature dependent flow control valve.

By providing a first coolant path for supplying coolant to the coolant jacket of the engine body and having a temperature dependent flow control valve, and a second cooling path for supplying coolant to the exhaust conduit coolant jacket, the present aspect of the invention allows the engine body to be controlled to a desired operating temperature while allowing the exhaust system to receive a supply of coolant, independently of the flow of coolant through the temperature dependant flow control valve.

One aspect of the present invention is the realization that when a thermostat is used in a cooling system to maintain a temperature of a component of the engine to a specified range by varying the flow of coolant therethough, other components receiving coolant from the cooling system can be adversely affected by adjustments to the flow rate of the coolant. For example, it has been found that in a watercraft engine that directs coolant flowing out of the engine block coolant jacket through a thermostat, into the exhaust manifold coolant jacket, the fluctuations in the coolant flow rate causes undesirable fluctuations in the temperature of the exhaust system. In fact, it has been found that such exhaust systems have cyclically overheated and cooled under certain operating conditions, due at least in part to the variations in the coolant flow rate caused by the thermostat. Such fluctuations have been found to adversely affect exhaust systems due to the heat cycling. Therefore, by providing the exhaust conduit coolant jacket with a coolant supply path independent from the engine thermostat the present aspect of the invention reduces the effect on the coolant flow rate through the exhaust conduit coolant jacket caused by the thermostat.

Further aspects, features and advantages of the present invention will become apparent from the detailed description of the preferred embodiment which follows.

BRIEF DESCRIPTION OF THE DRAWINGS

The above mentioned and other features of the invention will now be described with reference to the drawings of the preferred embodiment of a marine engine. The illustrated embodiment of the engine is intended to illustrate, but not to limit, the invention. The drawings contain the following figures.

DETAILED DESCRIPTION OF THE PREFERRED EMBODIMENT OF THE INVENTION

An improved engine for a personal watercraft is disclosed herein. The engine includes a cooling system for cooling the engine provided within the watercraft, which allows an engine body of the engine to be controlled to a desired temperature, while reducing the risk that the exhaust system temperatures may exceed a desired operating range. Thus, the engine performance is enhanced while adverse heat cycling of the exhaust system is prevented.

Although the present engine is illustrated in connection with a personal watercraft, the illustrated engine can be used with other types of watercraft as well, such as, for example, and without limitation, small jet boats and the like. Additionally, although the present engine includes a direct cylinder injection fuel delivery system, the cooling system according to the present invention can be used with fuel delivery systems other than direct cylinder injection (e.g., induction system injection, and carburation). Before describing the cooling system and its arrangement within a watercraft, an exemplary personal watercraft 10 will first be described in general details to assist the reader's understanding of the environment of use and the operation of the cooling system flow.

Figure 1:
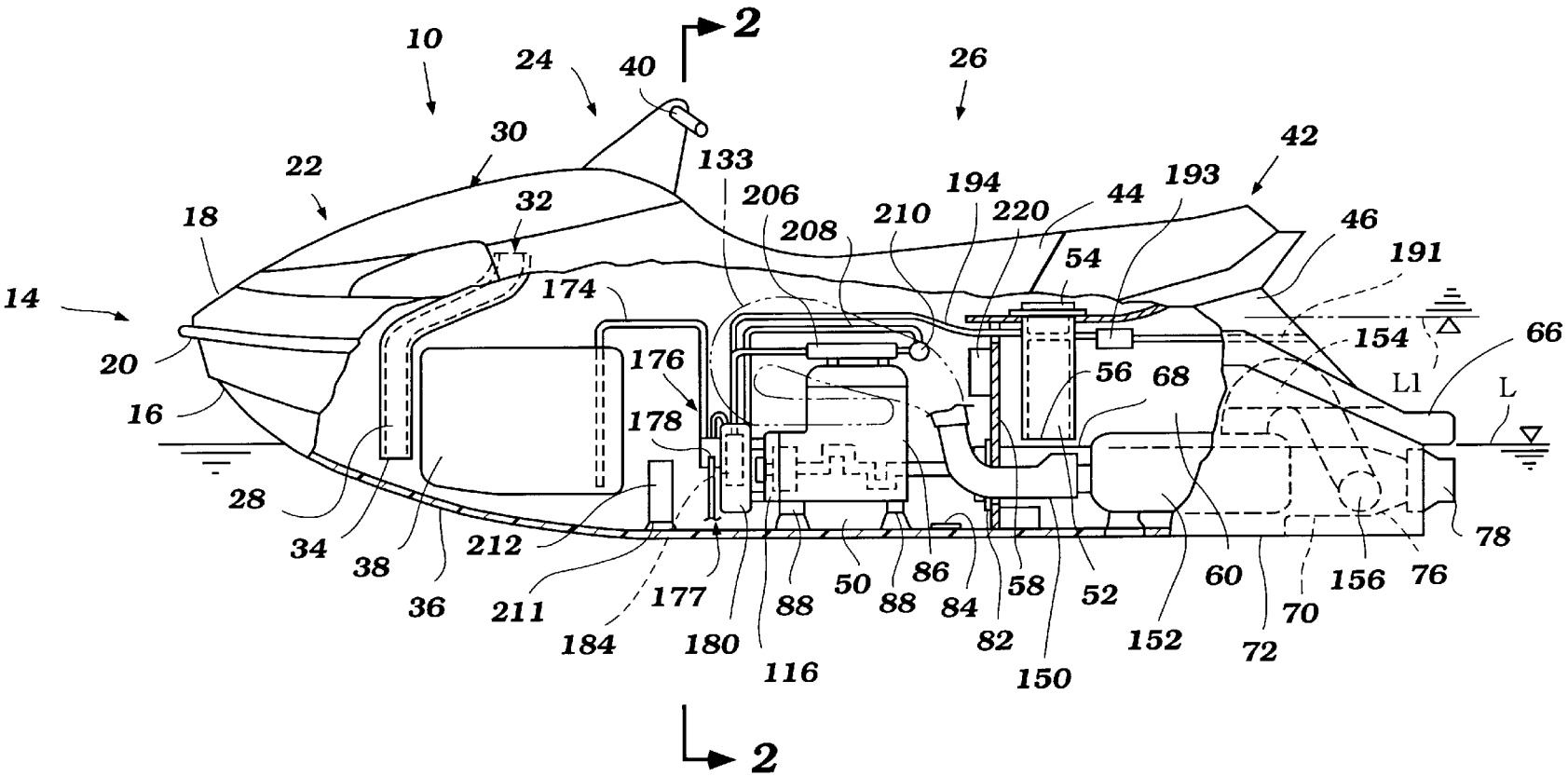
FIG. 1 is a side elevational view of a personal watercraft constructed in accordance with a first embodiment of the invention, with a partial cut-away view of the internal components.
Figure 2:
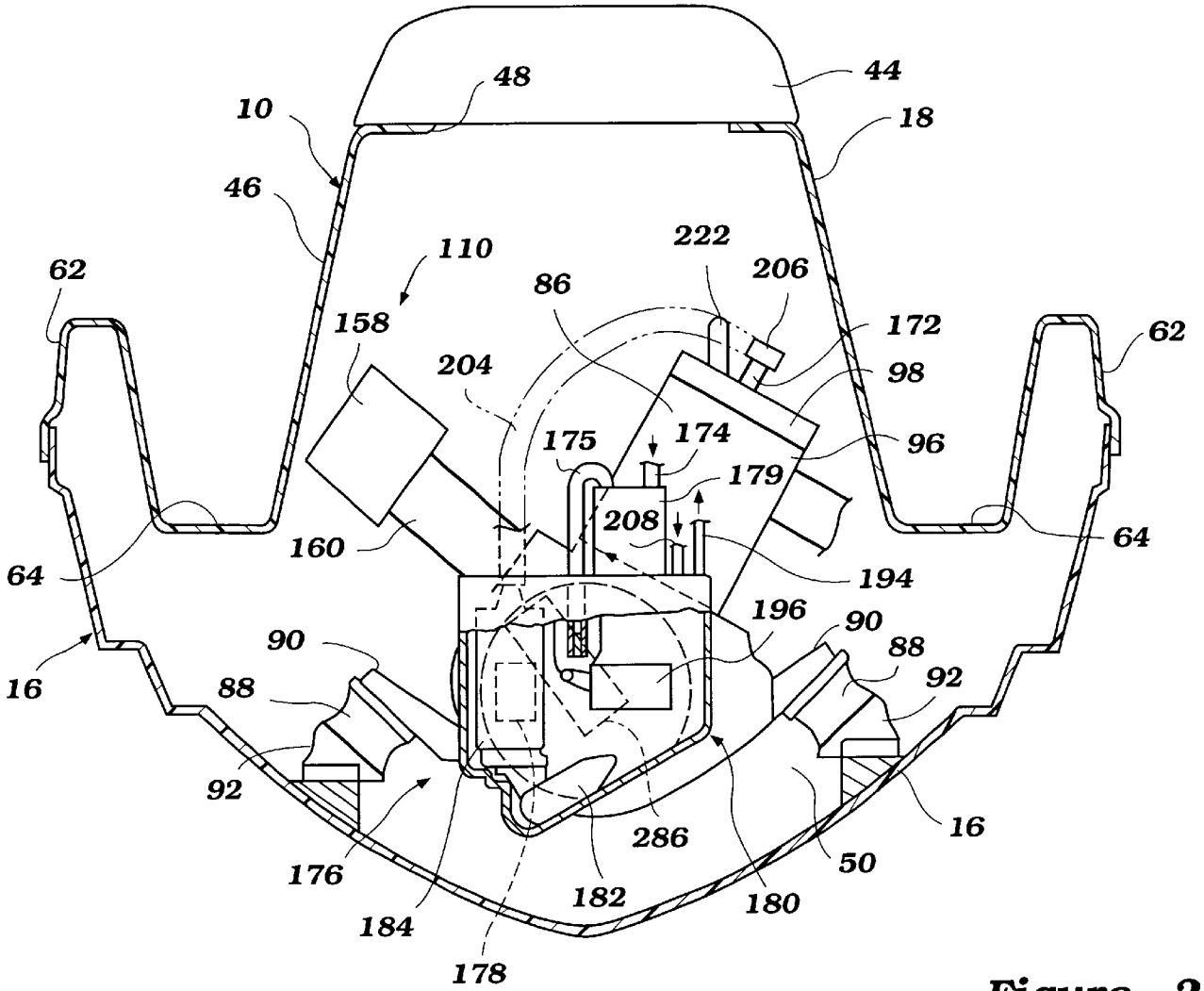
FIG. 2 is a cross-sectional view along line 2.—2. of the watercraft shown in FIG. 1 with certain components omitted.
Figure 3:
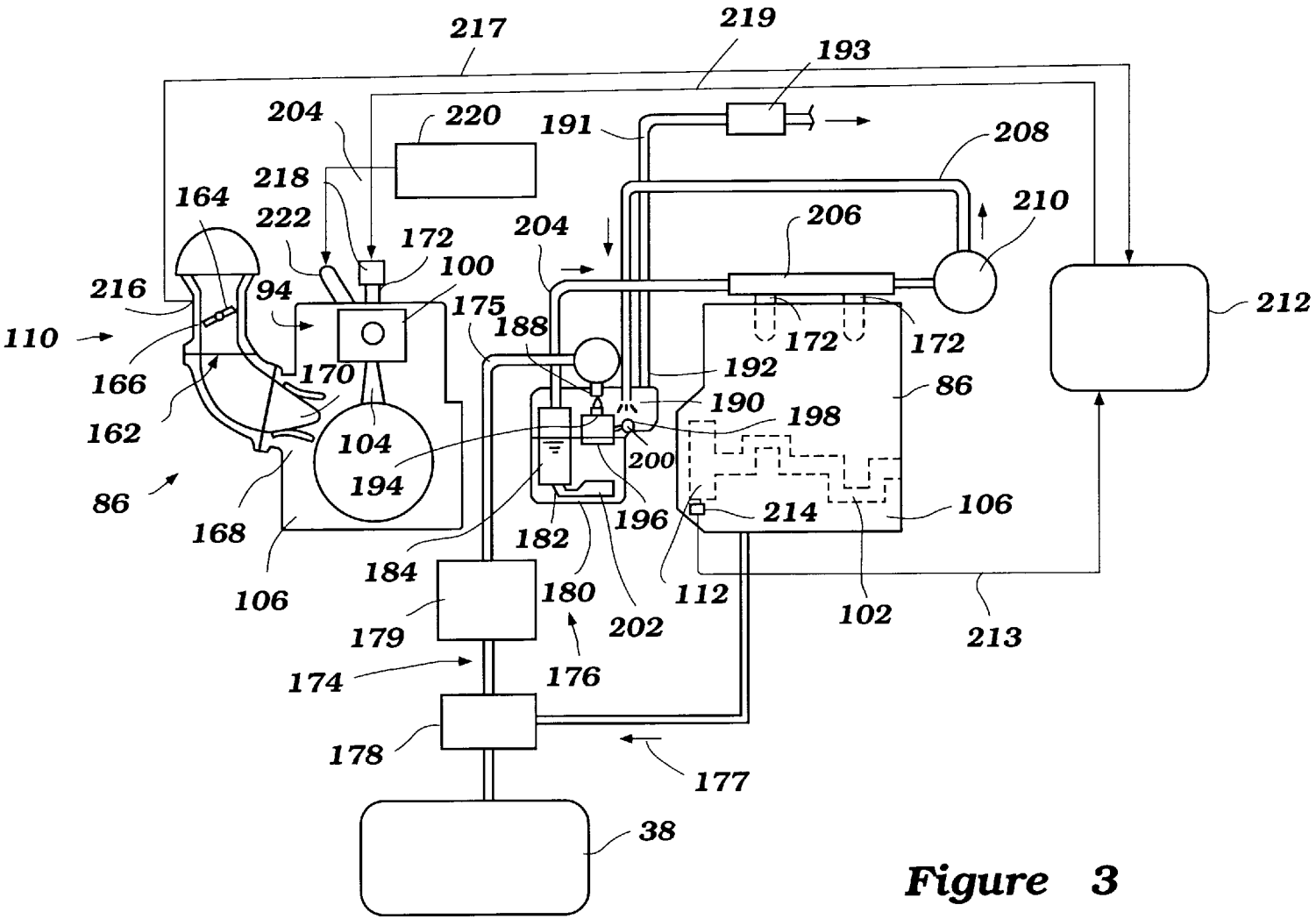
FIG. 3 is a schematic representation of the fuel delivery and induction systems of the engine shown in FIG. 2.

With initial reference to FIGS. 1–3, the watercraft 10 includes a hull 14 formed of a lower hull section 16 and an upper hull section 18. The hull sections 16 and 18 are formed of a suitable material, such as, for example, a molded fiberglass reinforced resin (e.g., SMC). The lower hull section 16 and the upper hull section 18 are fixed together around the peripheral edges or gunnels 20 in any suitable manner.

As viewed in a direction from bow to stern of the watercraft 10, the upper hull section 18 includes a bow portion 22, a control mast portion 24. and a rider's area 26. The bow portion 22 slopes upwardly towards the control mast 24 and includes at least one air duct 28 through which air enters the hull 14. A hatch cover 30 desirably extends above an upper inlet 32 of the air duct 28 to inhibit an influx of water into the hull 14.

As seen in FIG. 1, the air duct 28 terminates at a lower end opening 34 located near a lower surface 36 of lower hull section 16.

A fuel tank 38 is located within the hull 14 beneath the hatch cover 30. Conventional means, such as, for example. straps, secure the fuel tank 38 to the lower hull section 16. A fuel filler hose (not shown) preferably extends between fuel tank 38 and a fuel cap assembly arranged on the bow portion 22 of the upper portion 18, to the side and in front of the control mast 24. In this manner, the fuel tank 38 can be filled from outside the hull 14 with the fuel passing, through the fuel filler hose into the fuel tank 38.

The control mast 24 extends from the bow portion 22 and supports a handlebar assembly 40. The handlebar assembly 40 controls the steering of the watercraft 10 in a conventional manner. The handlebar assembly also carries a variety of controls of the watercraft 10, such as, for example, a throttle control, a start switch, and a lanyard switch.

The rider's area 26 lies behind the control mast 24 and includes a seat assembly 42. In the illustrated embodiment. the seat assembly 42 has a longitudinally extending straddle-type shape that can be straddled by an operator and by at least one, two, or three passengers. The seat assembly 42 is, at least in principal part, formed by a seat cushion 44 supported by a raised pedestal 46. The raised pedestal has an elongated shape and extends longitudinally along the center of the watercraft 10. The seat cushion 44 desirably is removably attached to the top surface of the pedestal 46 and covers the entire upper end of the pedestal 46 for the rider and passenger's comfort.

In the illustrated embodiment, the seat cushion 44 has a single piece construction. Alternatively, the seat cushion 44 may be formed in sectional pieces which are individually attached to the seat pedestal 50. In this manner. one sectional piece of the seat cushion 44 can be removed to expose a portion of the watercraft beneath the seat cushion 44, without requiring removal of the other sectional piece(s). For instance, a rear sectional piece of the seat cushion 44 can be removed to gain access to a storage compartment located beneath the seat without requiring removal of a front sectional piece of the seat cushion 44.

As shown in FIG. 2, an access opening 48 is located on an upper surface of the pedestal 46. The access opening 48 opens into an engine compartment 50 formed within the hull 14. The seat cushion 44 normally covers and seals the access opening 48. When the seat cushion 44 is removed, the engine compartment 50 is accessible through the access opening.

As shown in FIG. 1. the seat pedestal 46 also desirably includes at least one air duct 52 located behind the access opening 48. The air duct 52 communicates with the atmosphere through an upper end port 54 located within a space between the pedestal 46 and the seat cushion 44 and rearward from the access opening 48. The rear air duct 52 terminates in a lower end opening 56.

As shown in FIG. 1, the hull 14 preferably includes a divider wall or "bulkhead" 58 mounted rearward from the access opening 48. The bulkhead 58 cooperates with the seat pedestal 46 so as to define a propulsion unit chamber 60 arranged rearward from the engine compartment 50.

The rear air duct 52 terminates at a position within the propulsion unit chamber 60. Air can pass through the rear duct 54 in both directions.

As shown in FIG. 2, a bulwark 62 extends outwardly along each side of the watercraft 10. A footwell 64 is defined between the side of the pedestal 46 and the corresponding bulwark 62. In the illustrated embodiment, the footwells 64 extend entirely along the length of the seat assembly 42 and open into a rear deck 66 (FIG. 1) that is located at the aft end of the watercraft 10 above the transom. The footwells 64, however, can be closed at their aft end with a suitable drainage system provided.

The hull 14 is configured such that the watercraft 10 has sufficient buoyancy to float in a body of water in which the watercraft 10 is operated, regardless of the orientation of the hull 14 in the water. That is, as appreciated from FIG. 1, line L represents the water surface level relative to the watercraft 10 when the watercraft 10 is at rest in a body of water. In contrast., line L1 represents the water surface level relative to the watercraft 10 when the watercraft 10 is capsized in a body of water.

The lower hull section 16 is designed such that the watercraft 10 planes or rides on a minimum surface area at the aft end of the lower hull 16 in order to optimize the speed and handling of the watercraft 10 when up on plane. For this purpose, the lower hull section 16 generally has a V-shaped configuration, as apparent from FIG. 2, formed by a pair of inclined sections that extend outwardly from a keel of the hull to the hull's sidewalls at a dead rise angle. The inclined sections also extend longitudinally from the bow toward the transom of the lower hull 16. The sidewalls are generally flat and straight near the stern of the hull and smoothly blend towards the longitudinal center of the watercraft at the bow. The lines of intersection between the inclined sections and the corresponding sidewalls form the outer chines of the lower hull section 16.

Toward the transom of the watercraft, the inclined sections of the lower hull 16 extend outwardly from a recessed channel or tunnel 68 that extends upwardly toward the upper hull portion 18. The tunnel generally has a parallelepiped shape and opens through the transom of the watercraft 10.

Figure 4:
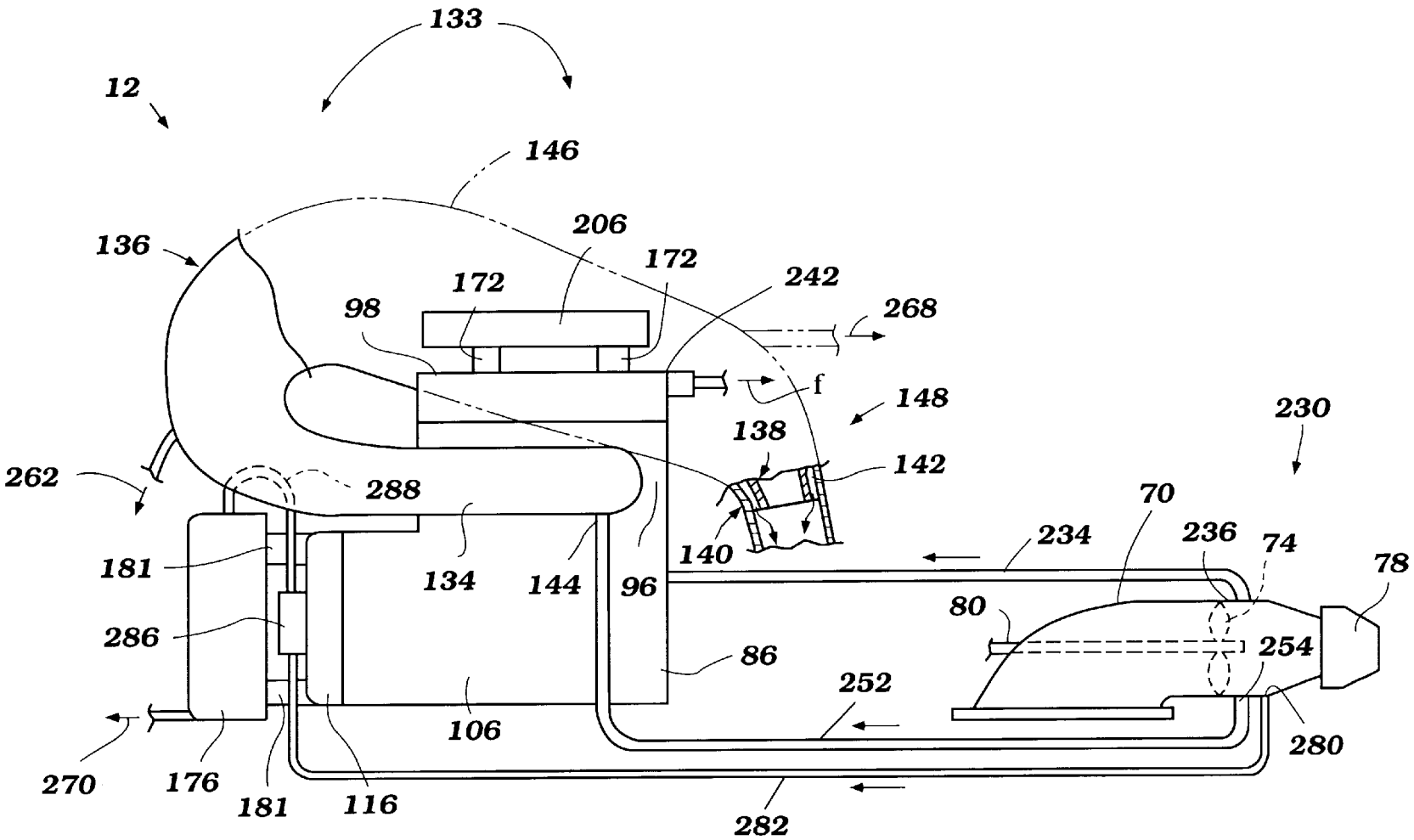
FIG. 4 is a side elevational view of the cooling system included in the watercraft shown in FIG. 1.

As shown in FIG. 1, a jet pump unit 70 is mounted within the tunnel 68. An inlet 72 to the jet pump unit 70 is formed in the lower surface of the lower hull section 16 which opens into a gullet of an intake duct leading to the jet pump unit 70. As shown in FIG. 4, the intake duct leads to an impeller housing, assembly in which an impeller 74 of the jet pump unit 70 operates. The impeller housing assembly also acts as a pressurization chamber and delivers the water flow from the impeller housing to a discharge nozzle 76.

A steering nozzle 78 is supported at a downstream end of the discharge nozzle 76 by a pair of vertically extending pivot pins. In an exemplary embodiment, the steering nozzle 78 has an integral lever on one side that is coupled to the handlebar assembly 40, through, for example, a bowden-wire actuator, as known in the art. In this manner, the operator of the watercraft can move the steering nozzle 78 to affect directional changes of the watercraft 10.

A ride plate covers a portion of the tunnel behind the inlet opening 70 to close the jet pump unit 66 within the tunnel. In this manner, the lower opening of the tunnel is closed to provide a plane surface for the watercraft 10.

As shown in FIG. 4, an impeller shaft 80 supports the impeller 74 within the impeller housing of the jet pump unit 70. The aft end of the impeller shaft 80 is suitably supported and journaled within the compression chamber of the jet pump unit 70 in a known manner. The impeller shaft 80 extends forwardly through a front wall of the tunnel, which is, in the illustrated embodiment, defined by the bulkhead 58. As shown in FIG. 1, the impeller shaft 80 is supported by a bearing 82 mounted to the bulkhead 58.

With reference to FIG. 1, the watercraft 10 may include a bilge system for removing water from the engine compartment 50 of the watercraft 10. The bilge system includes a water pick-up 84 located on the lower surface of the engine compartment 50, and at the aft end of the engine compartment 50 adjacent the bulkhead 58. The bilge system may employ a Venturi-type pump by utilizing a reduced pressure area formed within the jet pump unit 70. For this purpose, a bilge hose may connect water pick up 84 to the jet pump unit 70. The bilge system can alternatively include a mechanical bilge pump driven by an electric motor.

An internal combustion engine 86 of the watercraft 10 powers the impeller shaft 80 to drive the impeller 74 of the jet pump unit 70. As seen in FIGS. 1 and 2, the engine 86 is positioned within the engine compartment 50 and is mounted behind the control mast 24, beneath the seat assembly 42. In the illustrated embodiment, the engine 86 is arranged at a longitudinal position that is generally beneath the access opening 48 formed on the upper surface of the seat pedestal 46.

With reference to FIGS. 1 and 2. vibration absorbing engine mounts 88 secure the engine 86 to the lower surface of the lower hull section 16. As best seen in FIG. 2, the engine mounts 88 are attached to the engine 86 by a first set of brackets 90 and to the lower surface of the lower hull portion 16 by a second set of brackets 92. These lower brackets 92 are arranged to support the engine 86 at a distance above the lower surface of the lower hull section 16, and at a desired location within the engine compartment 50.

In the illustrated embodiment, the engine 86 includes two in-line cylinders and operates on a two-stroke, crankcase compression principle. The engine 86 is positioned such that the row of cylinders is generally parallel to the longitudinal axis of the watercraft 10, running bow to stern. The axis of each cylinder is generally inclined relative to a vertical central plane of the watercraft 10, in which the longitudinal axis of the watercraft 10 lies. This engine type, however, is merely exemplary. Those skilled in the art will readily appreciate that the present cooling system 12 can be used with a variety of engine types having other numbers of cylinders, having other cylinder arrangements (e., vertical), and operating on other combustion principals (e.g., four stroke and rotary principals).

As best seen in FIG. 2, a cylinder block 96 and a cylinder head 98 desirably form the cylinders of the engine 86. As shown in FIG. 3, a piston 100 reciprocates within each cylinder of the engine 86. The pistons drive, an output shaft 102, such as a crankshaft, is driven in a known manner. A connecting rod 104 links the corresponding piston 100 to the crankshaft 102. The corresponding cylinder bore, piston and cylinder head of each cylinder forms a variable volume chamber, which defines a combustion chamber therein.

The output shaft 102 desirably is journaled within a crankcase 106. A plurality of individual crankcase chambers 108 to the engine 86 are formed within the crankcase 106 by dividing walls and sealing disks, and are thereby sealed from one another with each crankcase chamber communicating with a dedicated variable volume chamber. Each crankcase chamber 108 also communicates with an induction system 110 (which is described below in detail). Because the internal details of the engine 86 desirably are conventional, a further description of the engine construction is not believed necessary to understand and practice the invention.

Figure 6:
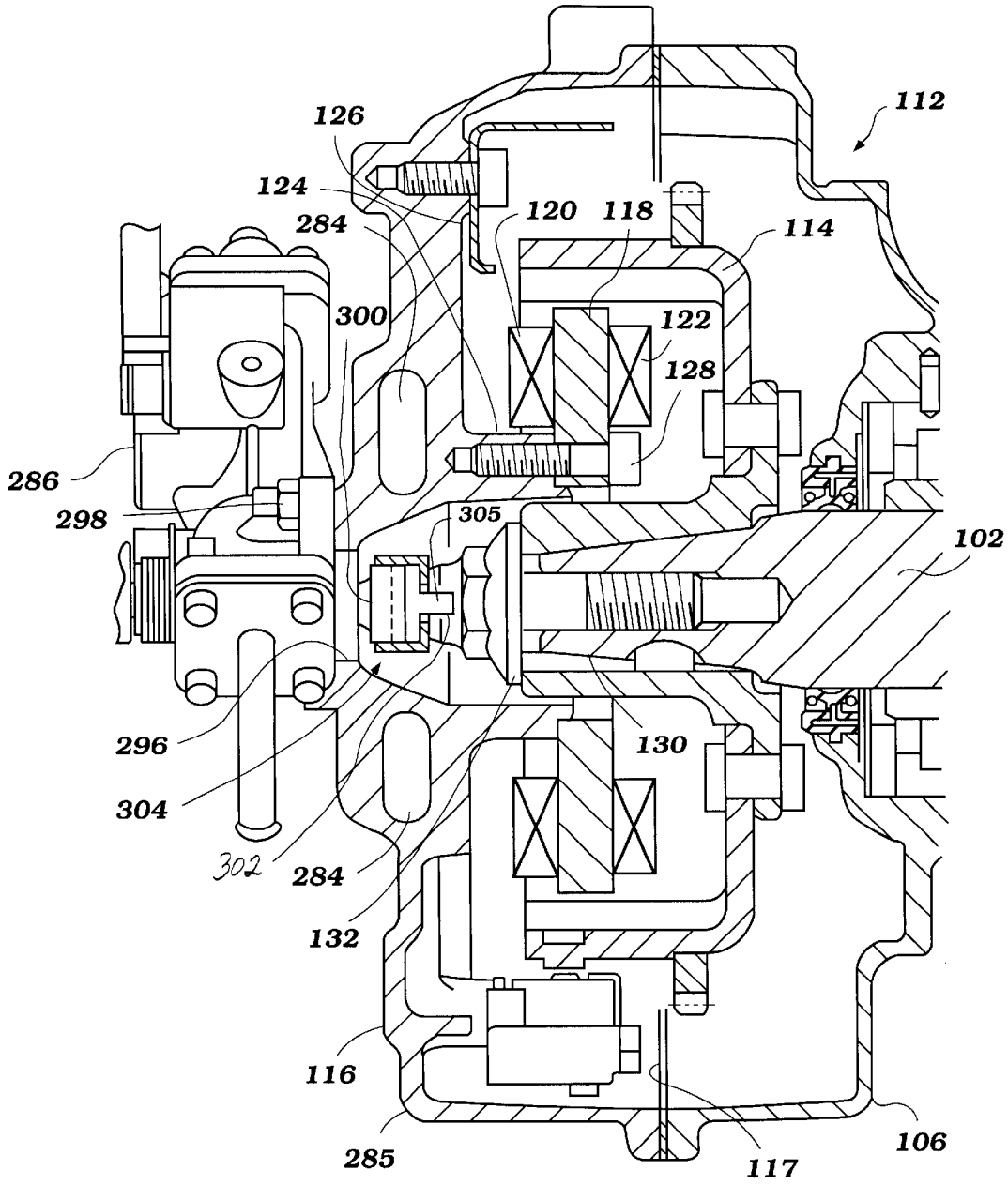
FIG. 6 is a partial cross-sectional view of a flywheel, flywheel cover and an oil pump included in the engine shown in FIG. 1.

As shown in FIG. 6, the output shaft 102 carries a flywheel assembly 112 on a front end 130 of the output shaft 102 at a position forward of the row of cylinders. The flywheel assembly 112 includes a flywheel magneto 114. A cover 116, as also shown in FIG. 1, is attached to a front opening 117 of the crankcase 106 to enclose the flywheel assembly 112.

As illustrated in FIG. 6, the flywheel magneto 114 is generally annular in shape and is fixed to a boss 115 which forms a hub for the flywheel magneto 114. The boss 115 is fixed to the front end 130 via a bolt 132 threadedly engaged with the front end 130 such that the flywheel magneto 114 rotates with the output shaft 102.

In contrast, a stator 118 having coils 120, 122 is mounted to a boss 124 protruding from an inner surface 126 of cover 116, via a plurality of bolts 128, so as to remain stationary relative to flywheel magneto 114.

Constructed as such, the flywheel assembly 112 forms an electric generator for supplying the watercraft 10 with an electric current. Alternatively, the watercraft 10 may include a generator mounted externally of the engine 86, and driven by a pulley system.

With reference to FIGS. 1 and 4, an exhaust system is provided to discharge exhaust by-products from the engine 86 to the atmosphere and/or into the body of water in which the watercraft 10 is operated. The exhaust system is formed of an exhaust conduit 133 which communicates with the combustion chambers defined in the engine body and is configured to discharge the exhaust gases to the atmosphere.

The exhaust conduit 133 includes an exhaust manifold 134 affixed to the side of the cylinder block 96 to receive exhaust gases from the variable volume chambers through exhaust ports in a well known manner.

At an outlet end, the exhaust manifold 134 communicates with a C-shaped pipe section 136. The C-shaped pipe 136 includes an inner tube 138 that communicates directly with the discharge end of the exhaust manifold 134. An outer tube 140 surrounds the inner tube 138 to form a coolant jacket 142 between the inner tube 138 and the outer tube 140. As shown in FIG. 4, the coolant jacket 142 includes an inlet 144 for receiving coolant.

The C-shaped pipe 136 includes an expansion chamber 146. In the illustrated embodiment, the expansion chamber 146 has a tubular shape. The coolant jacket 142 extends over the expansion chamber 146 and the exhaust manifold 134.

A discharge end 148 of the expansion chamber 146 tapers so as to reduce in cross-section and forms a downwardly turned portion. The inner tube 138 terminates at the discharge end 148 such that the water flowing through the water jacket 142 merges with the exhaust gas flowing through the inner tube 138 at the discharge end 148.

A connector 150, preferably formed from a flexible pipe, is connected to the discharge end 148 and extends rearward along one side of the watercraft hull tunnel 68.

The connector 150 connects to an inlet section of the water trap device 152 lying on the same side of the tunnel 68.

The water trap device 152 has a sufficient volume to retain water and to preclude the backflow of water to the expansion chamber 146 and the engine 86. Internal baffles within the water trap device 152 help control water flow through the exhaust system.

An exhaust pipe 154 extends from an outlet section of the water trap device 152 and wraps over the top of the tunnel 68 to a discharge end 156. The discharge end 156 desirably opens into the tunnel 68 in an area that is close to or below the water line L.

As seen in FIGS. 2 and 3, the induction system 110 is located on a side of the engine 86 opposite the exhaust system and supplies air to the variable volume chambers within the engine 86. In the illustrated embodiment, the induction system 110 includes an air intake silencer 158 which is connected to the variable volume chambers through a number of intake runners 160 corresponding to the number of cylinders within the engine 86. In the illustrated embodiment, there are two intake runners 160.

As shown in FIG. 3, the intake silencer 158 communicates with a plurality of throttle devices 162. The engine 86 desirably includes a number of throttle devices 162 equal in number to the number of cylinders within the engine 86.

In the illustrated embodiment, the throttle devices 162 are throttle valves. The throttle shaft supports a butterfly-type valve plate 164 within a throat 166 of the throttle device 162.

Each throttle device 162 communicates with an intake manifold through one of the intake runners 160. The intake manifold is attached to the crankcase 106 and/or cylinder block 96 to place each intake runner 160 in communication with one of the crankcase chambers. In the illustrated embodiment, the intake runner 160 desirably has an arcuate shape with a portion of the runner 160 extending generally transverse to a rotational axis of the crankshaft 102 and a longitudinal axis of the watercraft 10. As a result, the throttle device 162 and intake silencer 158 are distanced from the cylinder block and the cylinder head assemblies 96, 98.

A check valve (e.g., a reed valve) is disposed within each intake runner 160 at the junction between the intake manifold and the crankcase 106. In the illustrated embodiment, a reed valve assembly 168 includes a pair of reed valves 170 which open upon upward movement of the piston 100 to permit an influx of air into the corresponding crankcase chambers and which close upon downward movement of the piston 100, to inhibit reverse air flow from the crankcase chamber into the intake manifold.

The fuel delivery system of the illustrated embodiment is designed for direct cylinder injection of fuel through fuel injectors 172. However, the present cooling system can be used with other types of charge formers and arrangements of charge formers within the engine (e.g., intake passage injection) as well.

The engine 86 desirably includes the same number of fuel injectors 172 as the number of cylinders. In the illustrated embodiment, the fuel injectors 172 spray fuel directly into the cylinders defined in the cylinder block 96 so as to operate under the direct injection principal.

As shown in FIG. 3, a fuel supply line 174 extends from the fuel tank 38 to the vapor separator assembly 176. A low pressure fuel pump 178 and a fuel filter 179 are provided along the fuel supply line 174, between the fuel tank 89 and the vapor separator assembly 176. A fuel filter outlet pipe 175 connects the fuel filter 179 with the fuel bowl 180.

As shown in FIG. 1, the vapor separator assembly 176 is preferably mounted directly to the engine 86 via a plurality of elastic members 181. By mounting the vapor separator assembly 176 directly to the engine 86 with the elastic members 181, vibration conducted to the vapor separator assembly 176 is attenuated.

The low pressure fuel pump 178 can either be mechanically or electrically driven. For instance, in the illustrated embodiment, the low pressure fuel pump 178 is diaphragm pump operated by the changing pressure within one of the crankcase chambers, via a pressure line 177. The pump, however, can be an impeller pump driven by an electric motor.

With reference to FIG. 3, the vapor separator assembly 176 includes a vapor separator as well as a high pressure pump 184 which is positioned within the housing of the vapor separator assembly 176. The housing defines an inner cavity which forms the fuel bowl 180. The housing can have a sloped bottom surface to ftinel the fuel towards an influent port 182 which is generally positioned at the bottom of the fiel bowl 180.

The housing also defines an inlet port 188, a return port 190, and a vapor discharge port 192. The vapor discharge port 192 is positioned to the side of the inlet port 188 at a position proximate to the upper end of the housing. A breather conduit 191 allows excess vapor to vent to the atmosphere. Alternatively the breather conduit 191 could be routed to return vapor to the fuel tank 38. Preferably, the breather conduit 191 includes an anti-back flow device 193 for preventing the influx of water into the fuel system when the watercraft 10 is capsized.

The inlet port 188 connects the fuel supply line 174 to the fuel bowl 180. A needle valve 194 operates at a lower end of the intake port 188 to regulate the amount of fuel within the fuel bowl 180. A float 196 within the fuel bowl 180 actuates the needle valve 194. The float 196 includes a buoyant body supported by a pivot arm 198.

The pivot arm 198 is pivotally attached to an inner flange within the housing by a pivot shaft 200 at a point proximate to the lower end of the housing inlet port 188. The pivot arm also supports the needle valve 194 in a position lying directly beneath a valve seat formed on the lower end of the inlet port 188. Movement of the pivot arm 198 causes the needle valve 194 to open and close the inlet port 188 by either seating against or moving away from the valve seat, depending on the rotational direction of the pivot arm 198.

In the illustrated embodiment. the pivot arm 198 rotates about a pivot shaft 200 which extends in a direction generally transverse to the longitudinal axis as well as the direction of travel of the watercraft 10. This orientation of the pivot shaft 200 generally isolates the function of the float 196 from turning movements of the watercraft 10. That is, the movement of the watercraft 10 when turning does not cause the float 196 to rotate about the pivot shaft 200. The pivot shaft 200, alternatively, may be arranged so as to extend it in a direction generally parallel to the direction of travel in order to isolate the float 196 from movements produced when the watercraft 10 accelerates or decelerates.

In operation, the low pressure portion of the fuel delivery system operates to maintain a preselected amount of fuel within the fuel bowl 180. For or example, the low pressure fuel pump 178 draws furl through a stand pipe in the fuel tank 38. The fuel is pressurized by the low pressure fuel pump 178, and is thereby urged through the fuel filter 179 and the fuel filter outlet pipe 175.

When the fuel bowl 180 contains a low level of fuel, the float 196 floats in a lower position, as shown in FIG. 3. The needle valve 194 is opened by the float 196 in this lower position and fuel flows from the fuel filter outlet pipe 175 and into the fuel bowl 180.

When the fuel bowl 180 contains a preselected amount of fuel, the float 196 rises to a level where it causes the needle valve 194 to seat against the valve seat at the lower end of the inlet port 188. The preselected amount of fuel desirably lies below the inlet port 188, the return port 190, and the vapor discharge port 192. As such the low pressure portion of the fuel delivery system maintains a predetermined amount of fuel in the fuel bowl 180 as a reservoir for the high pressure portion of the fuel delivery system.

The high pressure portion of the fuel delivery system is designed to pressurize fuel from the fuel bowl 180, and deliver the pressurized fuel to the fuel injectors 172. In the illustrated embodiment, the high pressure pump 184 is integrated into the vapor separator housing assembly 176. The high pressure pump 184 includes an influent port 182 which communicates with the fuel bowl 180 through a fuel strainer 202. The fuel strainer 202 lies generally at the bottom of the fuel bowl 180.

The high pressure pump 184 may include an electric motor which drives an impeller shaft of the high pressure pump 184. The impeller shaft supports an impeller that rotates in a pump cavity. In an exemplary embodiment, the pump is a centrifugal pump; however, other types of pumps, such as rotary vein pumps, can be used as well. Alternatively, the high pressure fuel pump 184 may be driven directly by the crankshaft 102.

The vapor separator assembly 176 desirably includes a lid which is removably attached to a base portion of the housing by a plurality of conventional fasteners. A seal extends around the periphery of the housing at the joint between the lid and the housing base.

As shown in FIG. 3, the high pressure pump 184 communicates with a fuel rail or manifold 206 via a conduit 204. A check valve (not shown) is disposed within the conduit 204 to prevent a back flow of fuel from the fuel rail 206.

The fuel rail 206 has an elongated shape. An inlet port of the fuel rail 206 communicates with the conduit 204 which carries fuel from the high pressure pump 184. The inlet port opens into a manifold chamber which extends along the length of the fuel rail 206.

The fuel rail 206 communicates with each fuel injector 172. In particular, the manifold chamber of the fuel rail 206 communicates with each a plurality of supply ports defined along the length of the fuel rail 206. Each supply port receives an inlet end of the corresponding fuel injector 172.

In the illustrated embodiment, the fuel rail lies generally parallel to the direction of travel of the watercraft 10, and also to the longitudinal axis of the watercraft 10 and the rotational axis of the crankshaft 102. The conduit 204 is desirably attached to the forward end of the fuel rail 206. such that fuel flows through the fuel rail 206 in the direction from bow to stern in order to utilize the momentum of the fuel toward the watercraft stern to increase the pressure within the fuel rail 206. As a result, a smaller size high pressure pump 184 can be used. Alternatively, the conduit can be attached to a rear portion of the fuel rail 206, so that the fuel flows in the opposite direction, i.e., stern to bow, but this would require a larger size high pressure fuel pump.

A fuel return line 208 extends between an outlet port of the fuel rail 206 and the fuel bowl 180 of the vapor separator assembly 176. The return line 208 completes the flow loop defined by the high pressure side of the fuel supply system to generally maintain a constant flow of fluid through the fuel rail 206. The constant fuel flow through the high pressure side of the fuel delivery system inhibits heat transfer to the fuel and thus produces fuel vaporization in the fuel rail 206.

A pressure regulator 210 is positioned along the return line 208. The pressure regulator 210 generally maintains a desired fuel pressure at the fuel injectors 172 sufficient for direct cylinder injection. The regulator 210 regulates pressure by dumping excess fuel back to the vapor separator assembly 176, as known in the art.

In operation, the high pressure fuel pump 184 draws fuel from the fuel bowl 180, through the strainer 202 and through the influence port 182. The high pressure fuel pump 184 then pressurizes the fuel and thereby pushes the fuel to the fuel rail 206. The fuel within the fuel rail 206 is maintained at a desired pressure by the interaction between the high pressure fuel pump 184 and the pressure regulator 210. The fuel injectors 172 are selectively operated to inject the pressurized fuel from the fuel rail 206, directly into the cylinders.

A control system manages the operation of the engine 86. The control system includes an electronic control unit (ECU) 212 that receives signals from various sensors regarding a variety of engine functions. As shown in FIG. 1. ECU 212 is mounted within the hull 14, via a support member 211 fixed to the lower hull section 16.

As schematically illustrated in FIG. 3, a crank sensor 214 is positioned adjacent a peripheral edge of the flywheel 196. The crank sensor 214 is electronically connected with the ECU 212 via an engine data line 213. A throttle position sensor 216 is mounted to the throttle valve 162 so as to sense a position thereof. The throttle position sensor 216 is electronically connected to the ECU 212 via a throttle data line 217.

In operation, the crank position sensor 214 senses the angular position of the crankshaft 102 and also the speed of its rotation. The sensor 214 produces a signal indicative of an angular orientation and speed, and directs the signal to the ECU 212 via the engine speed data line 213. The throttle position sensor 216 produces a signal indicative of the throttle valve position and directs the signal to the ECU 212 via the throttle data line 217.

The ECU 212 receives the signals from the sensors 214 and 216 to control injection timing and duration, as well as spark timing. For this purpose, the ECU 212 communicates with each fuel injector 172, and specifically the solenoid 218 used with each fuel injector 172, via a fuel injector control line 219. The FCU 212 controls the operation of the solenoid 218 in order to manage fuel injection timing and duration, the latter affecting the fuel/air ratio of the produced fuel charge.

The desired stociometric fuel/air ratio will depend upon the amount of air flow into the engine 86, which is a function of the opening degree of the throttle valve 162. This information is stored within a memory device with which the ECU 212 communicates.

The ECU 212 thus processes the information signal received from the throttle valve sensor 162 and determines the amount of fuel to be injected for the sensed operating condition of the engine. The ECU 212 also uses the information from the crankshaft sensor 214 to determine the point during the engine's revolution to initiate fuel injection.

The control system also includes an ECU 220 for controlling ignition timing. For this purpose, the ECU 220 controls a capacitor discharge ignition unit and the firing of the spark plums 222. File ECU 220 desirably controls the discharge of one ignition coil for each spark plug 212.

The flywheel assembly 112 powers one or more charging coils (schematically illustrated as part of the ECU 220) which increases the voltage of the charge eventually delivered to the spark plugs 222. The generator formed by the flywheel assembly 112 also charges one or more batteries (not shown), as known in the art.

The arrangement of the components of the engine 86. Engine control system, fuel supply system, and exhaust system are illustrated in FIGS. 1–3. The vapor separator 176 desirably lies between the front end of the engine 86 and the main fuel tank 38, and a space in front of the flywheel. The vapor separator 176 thus lies in an air flow stream between the air ducts 28 and 52 and near the air flow into the induction system. The air flow over the vapor separator 176 tends to cool the fuel flowing, therethrough.

With reference to FIG. 4, and in accordance with the present invention, the engine 86 includes a liquid cooling system 12 having a cooling supply 230. As shown in FIG. 4, a coolant supply 230 is formed in the propulsion unit 70 downstream from the impeller 74. Due to the rotation of the impeller 74 during operation of the watercraft 10, the coolant supply 230 is comprised of a high pressure area within the propulsion unit 70. However, it is conceived that other types of watercraft may form coolant supplies in other ways (e.g., a mechanical water pump separate from the propulsion unit or an electrically driven coolant pump). Additionally, a single-engine watercraft with multiple propulsion units or a multiple engine watercraft may form a coolant supply with more than one pump.

For example, a single-engine watercraft may include two propulsion units, each having a high pressure area formed therein via the rotation of an impeller. Similarly, a multiple engine watercraft may include one or more propulsion units driven by each engine. Although the cooling systems of such watercraft may include coolant supply lines connected to each of the propulsion units, the term "coolant supply" is intended to include a coolant supply formed by one or a plurality of propulsion units, or any combination of propulsion units and other mechanically or electrically driven coolant pumps.

Figure 5:
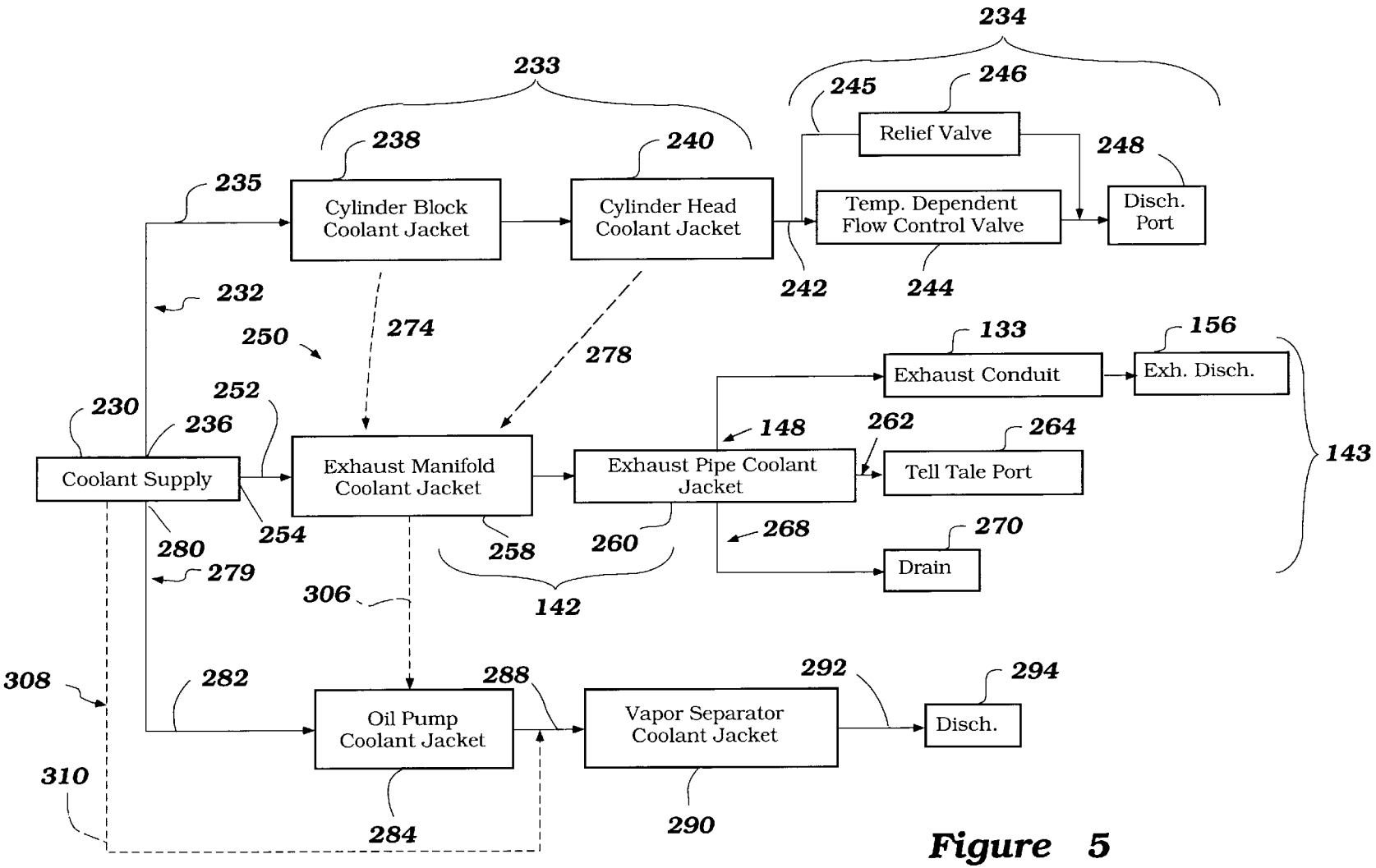
FIG. 5 is a schematic representation of the cooling system shown in FIG. 4.

As shown in FIG. 4, and schematically in FIG. 5, the cooling system 12 includes an engine coolant flow path 232 having by an engine coolant jacket 233 and a discharge portion 234.

The engine coolant jacket is connected to the coolant supply 230 via an engine coolant supply line 235 which is connected to the coolant supply via an inlet 236. At a downstream end, the engine coolant supply line 235 is connected to the engine coolant jacket 233 formed within the engine 86.

The engine coolant jacket 233 includes a cylinder block coolant jacket 238 in thermal communication with the cylinder block 96 and a cylinder head coolant jacket 240 in thermal communication with the cylinder head 98. The cylinder block coolant jacket 238 is in fluid communication with the cylinder head coolant jacket 240.

The cylinder head coolant jacket 240 includes an outlet 242 which leads to the discharge portion 234. The discharge portion 234 includes a temperature dependent flow control valve 244 and a discharge port 248. In the illustrated embodiment, the temperature dependent flow control valve 244 is a thermostat which is configured to open and close according to preselected temperatures.

As shown in FIG. 5, a relief valve 246 is connected to the outlet 242 via a relief valve line 245, in parallel with the temperature dependent flow control valve 244. In the illustrated embodiment, the relief valve 246 is configured to discharge water from the outlet 242 when a pressure of the water flowing through the outlet 242 is above a predetermined pressure.

As shown in FIG. 5, the temperature dependent flow control valve 244 and the relief valve 246 are connected to the discharge port 248 which discharges coolant to the atmosphere and/or the body of water in which the watercraft 10 is operated. Alternatively, the temperature dependent flow control valve 244 and the relief valve 246 may be connected to other portions of the cooling or exhaust systems, so as to eventually discharge the coolant flowing therethrough to the atmosphere.

In operation, pressurized water from coolant source 230 flows into inlet 236, engine coolant supply line 235 and into the engine coolant jacket 233. The water flowing through the engine coolant jacket 233 absorbs heat from the cylinder and head blocks 96 and 98, to thereby cool the engine 86.

In the illustrated embodiment, water from the propulsion device 70 is used as coolant. Coolant first enters the cylinder block coolant jacket 238, then the cylinder head coolant jacket 240, before being discharged through the discharge 242. Water leaving the discharge 242 enters the temperature dependent flow control valve 244, which, in the illustrated embodiment, is a thermostat.

When the temperature of the water flowing into the temperature dependent flow control valve 244 is within the predetermined operating range, i.e., above a predetermined threshold temperature, the temperature dependent flow control valve 244 remains open, allowing coolant to flow through the valve 244 and into the discharge port 248. In contrast, when the temperature of the water flowing into the valve 244 is below an operating temperature, i.e., below a predetermined threshold temperature, the valve 244 closes, thereby preventing water from flowing through the engine coolant jacket flow path 232. In such a state, the cylinder block 86 and the head block 98 will increase in temperature during normal operation of the engine 86. However, if the pressure in the discharge 242 reaches a predetermined threshold, the relief valve 246 allows water to flow, parallel to the valve 244, and into the discharge port 248.

With reference to FIGS. 4 and 5, the liquid cooling system 12 also includes an exhaust conduit coolant flow path 250. As shown in FIG. 5, the exhaust coolant jacket flow path 250 includes an exhaust conduit coolant jacket 142 and an exhaust coolant discharge portion 143.

In the illustrated embodiment, the exhaust conduit coolant jacket 142 is connected to the coolant supply 230 via an exhaust coolant supply line 252, which communicates with the coolant supply through an inlet 254.

The exhaust conduit coolant jacket 142 preferably includes an exhaust manifold coolant jacket 258 in thermal communication with the exhaust manifold 134 and an exhaust pipe coolant jacket 260 in thermal communication with the C-shaped pipe 136 and the expansion chamber 146.

The exhaust manifold coolant jacket 258 is in fluid communication with the exhaust pipe coolant jacket 260, so that coolant flowing out of the exhaust manifold coolant jacket 258 is directed into the exhaust pipe coolant jacket 260. A downstream end of the exhaust conduit coolant jacket 142 is connected to the exhaust coolant discharge portion 143.

The exhaust coolant discharge portion 143 includes at least one of the exhaust conduit 133, a telltale port 264 and a drain 270. However, the exhaust coolant discharge portion 143 preferably includes each of the exhaust conduit 133, the telltale port 264 and the drain 270.

As described above with respect to the exhaust system, the exhaust conduit 133 forms a discharge of the exhaust conduit coolant jacket 260 at the terminal end 148 of the exhaust conduit coolant passage 142, as shown in FIG. 4. At the terminal end 148, the exhaust pipe coolant jacket 260 opens into the exhaust conduit 133, which terminates at the exhaust discharge 156.

In the illustrated embodiment, the exhaust pipe coolant jacket 260 includes a discharge 262 which leads to a telltale port 264 provided on hull 14 of the watercraft 10. The telltale port 264 is preferably arranged so as to discharge a stream of coolant in a manner that is easily seen by the operator. Arranged as such, the operator is able to verify that coolant is flowing through the cooling system 12.

A discharge 268 communicating with the exhaust pipe coolant jacket leads directly to a drain 270 which discharges the coolant directly to the atmosphere, above or below the water line of the watercraft 10.

During operation of the watercraft 10, the exhaust conduit cooling flow path 250 receives a supply of pressurized coolant, e.g., pressurized water, from propulsion device 70. Pressurized water enters the inlet 252, flows through supply line 254, into the exhaust manifold coolant jacket 258 and into the exhaust pipe coolant jacket 260. The water flowing through the jackets 258 and 260 absorbs heat from the exhaust gasses flowing through the exhaust conduit 133. The water then flows out through at least one of the discharges 148, 262, and 268. Preferably the discharges 262 and 268 are preferably configured such that the remaining flow of coolant in the exhaust coolant flow path 250 is appropriate, as is known in the art.

For example, as the flow rate of coolant through the discharges 268 and 262 are increased, the flow rate of coolant through the terminal end 148 will be reduced. As is known in the art, there is a maximum flow rate of coolant through the terminal end 148 into the exhaust conduit 133. Therefore, by appropriately configuring discharges 268 and 262, the flow rates therethrough can be controlled so as to achieve an appropriate flow rate through the terminal end 148.

As shown in FIGS. 4 and 5, the liquid cooling system 12 may optionally include a cylinder block coolant bypass line 274 extending from the cylinder block coolant jacket 238 to the exhaust manifold coolant jacket 258, and/or a cylinder head coolant bypass line 278 extending from the cylinder head coolant jacket 240 to the exhaust manifold cooling jacket 258. Arranged as such, the bypass supply lines 274 and 278 allow coolant to flow out of the cylinder block coolant jacket 238 and/or cylinder head coolant jacket 240 regardless of the operation of temperature dependent flow control valve 244.

Accordingly, the exhaust conduit coolant jacket 142 may be configured to receive coolant from at least one of the coolant supply line 254 the cylinder block coolant bypass line 274, and the cylinder head coolant bypass line 278, while the flow therethrough will remain independent of the flow of coolant through the temperature dependent flow control valve 244.

As shown in FIGS. 4 and 5, the liquid cooling system 12 may also include an oil pump coolant flow path 279. In the illustrated embodiment, the oil pump coolant flow path 279 includes an inlet 280 connected to the coolant supply 230, and an oil pump coolant supply line 282 connecting the inlet 280 with an oil pump coolant jacket 284.

The oil pump coolant jacket 284 is in thermal communication with an oil pump 286. As shown in FIG. 6, the oil pump cooling jacket 284 is formed in an outer surface 285 of the flywheel cover 116. In the illustrated embodiment, the oil pump cooling jacket 284 is annular in shape and centered around an aperture 296 formed in the outer surface 285.

As shown in FIG. 6, the oil pump 286 is mounted to the outer surface 285 of the flywheel cover 116 by least one bolt 298. The oil pump 286 is arranged such that a drive shaft 300 of the oil pump 286 passes through the aperture 296 and is generally axially aligned with the crankshaft 102.

The drive shaft 300 of the oil pump 286 is connected to the bolt 132. The bolt 132 includes recess 302 formed in its head. A releasable coupling 304 releasably engages the drive shaft 300 with the recess 302 via a projection 305.

Arranged as such, the oil pump cooling jacket 284 primarily cools the oil pump 286 during operation of the watercraft 10. Additionally, in the illustrated embodiment, the oil pump cooling jacket 284 provides cooling for the flywheel assembly 112 as well.

An intermediate supply line 288 connects the oil pump coolant jacket 284 with a vapor separator coolant jacket 290 which is in thermal communication with the vapor separator assembly 176. Although the internal details of the vapor separator coolant jacket 290 are not shown, such coolant jackets are well known in the art and a further description is not believed necessary to understand and practice the invention. The vapor separator coolant jacket 290 includes a discharge line 292 which is connected to the coolant discharge 294 which discharges coolant to the atmosphere.

Alternatively, as shown in FIG. 5, the vapor separator coolant jacket 290 may be supplied with coolant independently of the oil pump coolant jacket 284. Accordingly, a vapor separator coolant path 308 extending between the coolant supply 230 and the vapor separator coolant jacket 290 may be provided. In the illustrated embodiment, the vapor separator coolant path 308 includes a vapor separator coolant supply line 310 connecting the coolant supply 230 with the vapor separator coolant jacket 290.

Optionally, an exhaust manifold coolant bypass line 306 may be provided to connect the exhaust manifold coolant jacket 258 with the oil pump coolant jacket 284. As such, coolant flowing through exhaust manifold coolant jacket 258, is directed into the oil pump coolant jacket 284.

In operation, water flows into the inlet 280, through the supply line 282, into the oil pump coolant jacket 284, and the vapor separator coolant jacket 290. After passing through the coolant jackets 284 and 290, the coolant is then discharged through coolant discharge 294. If the vapor separator coolant flow path 310 is included, then the vapor separator coolant jacket 290 may receive a flow of coolant from the oil pump coolant jacket 284 and/or the vapor separator coolant supply line 310.

As set forth above, the exhaust conduit coolant jacket 142 may be supplied with coolant from at least one of the coolant supply 230 and a portion of the engine coolant jacket 236 that is upstream from the temperature dependent flow control valve 244. Therefore, the flow of coolant through the engine exhaust conduit coolant flow path 272 is generally independent of the flow of coolant through the temperature dependent flow control valve 244. This provides an important advantage.

For example, during operation, the temperature dependent flow control valve 244 may open and close depending on the temperature of coolant flowing therethrough. As discussed above, the coolant flowing through the temperature dependent flow control valve 244 is directed from the coolant supply and through the engine coolant jacket 236. Therefore, if the exhaust conduit coolant jacket 142 were fed with coolant flowing out from the temperature dependent flow control valve 244, the temperature of the exhaust conduit 136 could not influence the operation of the valve 244.

One aspect of the present invention is the realization that exhaust systems used on modern watercraft have become overheated and have been subjected to adverse heat cycling due to the use of control devices for controlling the flow of coolant through the engine coolant jackets. For example, as a flow control device which controls the flow of coolant through an engine coolant jacket, such as the temperature dependent flow control valve 244, opens and closes to control the temperature of the engine, such as the engine 86, the flow of water out from the valve 244 varies. Therefore, if a downstream device, such as exhaust conduit 133, is cooled only with water flowing out of the valve 244, the flow of water through a water jacket formed on that device, will not necessarily correspond to the temperature of that device.

It has been found that watercraft which cool the exhaust system with water flowing out of a temperature dependent flow control device, have caused damage to their exhaust systems. Therefore, by providing the exhaust conduit coolant jacket with a supply of coolant independent of the temperature dependent flow control valve 244, the present invention reduces the risk that the exhaust conduit 136 will be subjected to overheating and/or adverse heat cycling due to the variations in coolant flow caused by a temperature dependent flow control valve.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A watercraft comprising a propulsion system including an engine, the engine having a body defining at least one combustion chamber therein and having at least one coolant jacket therein, an exhaust conduit communicating with the at least one combustion chamber and extending to an exhaust discharge arranged to discharge exhaust gases from the at least one combustion chamber through the exhaust conduit and to the atmosphere, the exhaust conduit having a coolant jacket in thermal communication with at least a portion thereof, a coolant supply configured to generate pressurized coolant, a cooling system defining a first coolant flow path extending from the coolant supply, in a downstream direction, through the engine coolant jacket, through a temperature dependent flow control valve, and to the atmosphere, a second coolant flow path having an inlet end connected to at least one of the coolant supply and a portion of the first coolant flow path upstream of the temperature dependent flow control valve, the second coolant flow path communicating with the exhaust conduit coolant jacket and discharging coolant to the atmosphere, the second coolant flow path not being connected to any portion of the first coolant flow path downstream of the temperature dependent control valve.

2. A watercraft as set forth in claim 1, wherein the first coolant flow path comprises a first coolant line extending from the coolant supply to the engine coolant jacket, through the engine coolant jacket, and through the temperature dependent flow control valve, and a second coolant line extending from the temperature dependent flow control valve to at least one of an exterior of the watercraft and an interior of the exhaust conduit.

3. A watercraft as set forth in claim 1, wherein the portion of the first coolant flow path is upstream of the engine coolant jacket.

4. A watercraft as set forth in claim 1, wherein the engine coolant jacket comprises a cylinder block coolant jacket, the watercraft additionally comprising a third coolant flow path extending from the cylinder block coolant jacket to the exhaust conduit coolant jacket.

5. A watercraft as set forth in claim 4, wherein the exhaust conduit coolant jacket comprises an exhaust manifold coolant jacket, the second coolant flow path extending from the cylinder block coolant jacket to the exhaust manifold cooling jacket.

6. A watercraft as set forth in claim 1, wherein the engine coolant jacket comprises a cylinder head coolant jacket, the watercraft additionally comprising a third coolant flow path extending from the cylinder head coolant jacket to the exhaust conduit coolant jacket.

7. A watercraft as set forth in claim 6, wherein the exhaust conduit coolant jacket comprises an exhaust manifold coolant jacket, the second coolant flow path extending from the cylinder head coolant jacket to the exhaust manifold cooling jacket.

8. A watercraft as set forth in claim 7, wherein the engine coolant jacket additionally comprises a cylinder block coolant jacket, the watercraft additionally comprising a fourth coolant line extending from the cylinder block coolant jacket to the exhaust conduit coolant jacket.

9. A watercraft as set forth in claim 8, wherein the fourth coolant line extends from the cylinder block coolant jacket to the exhaust manifold conduit coolant jacket.

10. A watercraft as set forth in claim 1 additionally comprising a relief valve provided in the first coolant flow path and connected in parallel with the temperature dependent flow control valve.

11. A watercraft comprising a propulsion system including an engine, the engine having a body defining at least one combustion chamber therein and having at least one coolant jacket therein, an exhaust conduit communicating with the at least one combustion chamber and extending to an exhaust discharge arranged to discharge exhaust gases from the at least one combustion chamber through the exhaust conduit and to the atmosphere, the exhaust conduit having a coolant jacket in thermal communication with at least a portion thereof, a coolant supply configured to generate pressurized coolant, a cooling system defining a first coolant flow path extending from the coolant supply, in a downstream direction, through the engine coolant jacket, and through a temperature dependent flow control valve, a second coolant flow path extending from at least one of the coolant supply and a portion of the first coolant flow path upstream of the temperature dependent flow control valve, the second coolant flow path communicating with the exhaust conduit coolant jacket, an oil pump configured to generate pressurized oil for the engine and having a oil pump coolant jacket, and a third coolant flow path extending from at least one of the coolant supply and the first coolant flow path at a position upstream of the temperature dependent flow control valve, and extending to the oil pump coolant jacket.

12. A watercraft as set forth in claim 11 additionally comprising a fourth coolant flow path extending from the exhaust conduit coolant jacket to the oil pump coolant jacket.

13. A watercraft as set forth in claim 11 additionally comprising a flywheel cover mounted to an end of the engine, the oil pump cooling jacket comprising a coolant passage defined in the flywheel cover.

14. A watercraft as set forth in claim 1 additionally comprising a fuel vapor separator having a vapor separator coolant jacket and a third coolant flow path extending from at least one of the coolant supply and the first coolant flow path at a position upstream from the temperature dependent flow control valve, and extending to the vapor separator coolant jacket.

15. A watercraft as set forth in claim 14 additionally comprising an oil pump having an oil pump coolant jacket, and a fourth coolant flow path extending from the oil pump coolant jacket to the vapor separator coolant jacket.

16. A watercraft comprising a propulsion system wherein the propulsion system comprises an engine including a body defining at least one combustion chamber therein and having at least one coolant jacket therein, an exhaust conduit communicating with the least one combustion chamber and extending to an exhaust discharge arranged to discharge exhaust gases from the at least one combustion chamber through the exhaust conduit and to the atmosphere, the exhaust conduit having an exhaust conduit coolant jacket in thermal communication with at least a portion thereof, a coolant supply configured to generate pressurized coolant, a cooling system defining a first coolant flow path extending from the coolant supply, in a downstream direction, through the engine coolant jacket, and through a temperature dependent flow control device, and means for supplying the exhaust conduit coolant jacket with coolant from the coolant supply independently from the temperature dependent flow control device and for discharging coolant from the exhaust conduit coolant jacket independently from an entire portion of the first coolant supply path downstream from the temperature dependent flow control valve.

17. A watercraft comprising a propulsion system wherein the propulsion system comprises an engine including a body defining at least one combustion chamber therein and having at least one coolant jacket therein, an exhaust conduit communicating with the least one combustion chamber and extending to an exhaust discharge arranged to discharge exhaust gases from the at least one combustion chamber through the exhaust conduit and to the atmosphere, the exhaust conduit having an exhaust conduit coolant jacket in thermal communication with at least a portion thereof, a coolant supply configured to generate pressurized coolant, a cooling system defining a first coolant flow path extending from the coolant supply, in a downstream direction, through the engine coolant jacket, and through a temperature dependent flow control device, means for supplying the exhaust conduit coolant jacket with coolant from the coolant supply independently from the temperature dependent flow control device, an oil pump configured to generate pressurized oil for the engine, the oil pump including an oil pump coolant jacket, and means for supplying coolant to the oil pump coolant jacket.

18. A watercraft as set forth in claim 16 additionally comprising a fuel vapor separator having a vapor separator coolant jacket, and means for supplying coolant to the vapor separator coolant jacket.

* * * * *